US005829594A

United States Patent [19]

Warder

[11] Patent Number: 5,829,594

[45] Date of Patent: Nov. 3, 1998

[54] PROTECTIVE ENCLOSURE FOR SHIPPING AND STORING HAZARDOUS MATERIALS

[75] Inventor: William G. Warder, Weston, Mo.

[73] Assignee: Pro-Tech-Tube, Inc., Kansas City, Mo.

[21] Appl. No.: 883,836

[22] Filed: Jun. 27, 1997

[51] Int. Cl.[6] ..... B65D 43/02

[52] U.S. Cl. ..... 206/459.1; 206/523; 220/276; 220/801

[58] Field of Search ..... 206/524.1, 524.2, 206/524.3, 523, 459.5, 459.1; 220/797, 798, 266, 276, 800–804; 424/404; 976/DIG. 349

[56] References Cited

U.S. PATENT DOCUMENTS

| | | | |
|---|---|---|---|
| 597,726 | 1/1898 | Lovell . | |
| 2,283,867 | 5/1942 | Flosdorf et al. . | |
| 2,878,848 | 3/1959 | Coltman, Jr. | 220/789 |
| 3,401,791 | 9/1968 | Stott et al. . | |
| 3,613,874 | 10/1971 | Miller . | |
| 3,730,374 | 5/1973 | Picciano et al. . | |
| 3,799,426 | 3/1974 | Pates et al. . | |
| 4,190,175 | 2/1980 | Allen | 220/276 |
| 4,240,547 | 12/1980 | Taylor . | |
| 4,567,014 | 1/1986 | Popp et al. | 976/DIG. 349 |
| 4,872,563 | 10/1989 | Warder et al. | 206/524.3 |
| 5,040,678 | 8/1991 | Lenmark, Sr. et al. | 206/459.1 |
| 5,231,938 | 8/1993 | Gore | 206/524.1 |
| 5,503,835 | 4/1996 | Van Roekel | 424/404 |

FOREIGN PATENT DOCUMENTS

| | | |
|---|---|---|
| 1240555 | 8/1960 | France . |
| 2128357 | 10/1972 | France . |
| 924339 | 5/1956 | Germany . |
| 1275939 | 8/1968 | Germany . |

*Primary Examiner*—Jimmy G. Foster
*Attorney, Agent, or Firm*—Shook, Hardy & Bacon L.L.P.

[57] ABSTRACT

The present invention relates to a device for transporting materials which are potentially hazardous in primary containers, especially biological materials. The device comprises an enclosure having a top that snapably locks into a body to prevent removal of the top after it is placed into the body. The body includes a grasping flange which can be engaged and pulled along a spiralling line of weakness to rip open a top portion of the body section which does not directly house the specimen containers. The inside of the shipping container includes a resilient material to cushion any shock that the shipping container might undergo. The resilient material is preferably highly absorbent and is impregnated with one or more of several visual indicators, so that in the unlikely event a primary specimen container breaks, its contents will be absorbed, held inside the shipping container, and even the casual observer will be aware that a specimen leak has occurred. In addition, a surfactant is included in the shipping container to render the specimen inert. The body is provided with a U-shaped groove to receive a terminal edge of the lid to seal the shipping container from leaks.

20 Claims, 4 Drawing Sheets

PROTECTIVE ENCLOSURE FOR SHIPPING AND STORING HAZARDOUS MATERIALS

BACKGROUND OF THE INVENTION

1. Field of the Invention

The present invention relates to shipping devices, and is more specifically directed to an improved protective enclosure device for safely and conveniently shipping hazardous materials such as biological infectious substances.

2. Related Art

Medical diagnostic methods and techniques involving the analysis of biological specimens such as blood, urine and other body fluids have proven invaluable for diagnosing and mitigating illnesses or disease in man, animals or the environment and are being used with increasing frequency. These specimens are routinely collected at sites other than the laboratories where the diagnostic methods are ultimately performed. For example, blood and urine samples are commonly taken at the office or home of a prospective life insurance applicant, and then packaged and mailed to a laboratory for testing. With the onslaught of diseases such as Acquired Immune Deficiency Syndrome (AIDS) which may be transmitted via bodily fluid contact, and the ever increasing number of biological specimens being transported via the mail and courier services, the integrity and safety of shipping devices used to transport these specimens is of great importance.

Various regulations govern the labels that are affixed to shipping devices having biological specimens contained therein so as to notify and warn potential handlers of the device of the contents. There are some regulations which provide minimal standards for the shipping devices themselves. Shipping devices have been designed and are currently in use which are in compliance with these standards.

One such device is disclosed in U.S. Pat. No. 4,872,563 to Warder et al. which is hereby fully incorporated herein by reference. The '563 patent discloses a shipping device comprising an enclosure having a top that locks onto a body section so as to substantially preclude the removal of the top after locking in place. The body section includes a tab which can be grasped and pulled along a line of weakness extending the entire length of the interior wall of the body section to rip open the device once it reaches its destination. The primary specimen container is stored within the enclosure surrounded by a resilient padding or liner to protect the vial from breakage. This resilient liner may include a germicidal or pesticidal substance in the event of breakage so that the contents of the vial are contained within the enclosure. A shock exposure indicator is provided on the top to indicate if the device has been exposed to a sudden shock.

While this prior device is useful in shipping hazardous materials, a need remains in the art to develop improved devices which further reduce the risk that the primary specimen containers held within the devices will break during shipment or that the shipping device will inadvertently open or leak. It is also desirable to develop a device which will enable a user to open the device in a manner which will reduce the risk of user contact with the hazardous material if a spillage has in fact occurred. In addition, it is an objective to provide a direct mechanism for detecting and then warning individuals when a breakage has occurred to reduce the risk of injury and infection to individuals handling and opening the shipping containers. Further, an improved device that is well adapted for use in mechanized shipping operations including conveyer transport and bar code readers is desirable.

BRIEF SUMMARY OF THE INVENTION

These and other objects are achieved by an improved protective enclosure device for shipping primary containers of hazardous materials such as potentially infectious biological specimens. The improved device comprises a cylindrical main body defining a central cavity with an open top and a closed bottom, and a closure lid configured to be securely mounted within the confines of an upper lid receiving section of the main body. In order to fully seal the lid in place so as to prevent leakage, a circumferential channel or groove is provided along the interior wall of the lid receiving section of the main body. A flexible peripheral flange extending outwardly along the terminal bottom edge of the lid is configured to be received within the groove so as to seal the body closed.

External lines of weakness are formed within the lid receiving section of the main body so as to define an opening flap which may be opened by pulling outward and downward on a tab along the upper rim of the main body. To assist the user in opening the device, a hole is provided within the tab so that the user can insert a dowel or other object into the aperture and apply the necessary pressure to open the flap.

Since the lines of weakness are external, the sealing lock created between the internal groove of the main body and the circumferential ridge of the lid is continuous. Furthermore, by providing the opening flap within the confines of the upper lid receiving section of the main body and not within the lower storage section of the device, the user will be able to visually inspect the storage area of the device upon removing the flap and the lid. In this manner if a spill has occurred, the user is not immediately exposed to direct contact with the contents of the primary container upon opening the device.

In a preferred embodiment of the invention, the shipping device is further provided with a direct visual indicator, preferably a pH indicator which will change color upon contact with the contents of the primary container, placed inside the device for detecting specimen leaks. The device can include a clear window such that the color change is detected even before the user starts to open the device. In this embodiment, a fluorescent indicator can be used such that a spillage can be detected by simply placing the device under ultraviolet light.

In order to cushion and further protect the specimen vials or containers held within the device, a resilient cushioning member having a plurality of cylindrical channels for snugly receiving the primary containers may be provided within the central cavity below the lid receiving region. To prevent the cushioning member from rotating and moving within the cavity, reinforcing ribs extending vertically inward from the interior wall of the main body are configured to mate with vertically extending slots provided on the outer surface of the cushioning member. These reinforcing ribs also serve to further stabilize the overall structural integrity of the device. Alternatively, the primary containers may be wrapped or rolled within a sheet of resilient cushioning material. A solid top cushion is provided within the lid receiving portion of the central cavity.

As is disclosed in the '563 patent incorporated herein by reference, the cushioning member may be impregnated with a germicidal or pesticidal substance to neutralize the specimen if it is spilled or leaks. To further protect a user from potential contact with any spilled contents, a plastic sealed containment bag may be provided around the cushioning member. The containment bag may also include an exterior pocket for holding written documentation regarding the contents of the primary containers.

Further, the device may include a square or rectangular flange extending outwardly from the closed bottom and the upper rim of the main body. This flange will assure that the device is maintained in a fixed position when being transported along a conveyer, as opposed to rolling on the conveyer. Bar code or other identifying indicia provided on the outside of the main body can then be easily read without the need for manually holding the device.

BRIEF DESCRIPTION OF THE DRAWINGS

These and other features, advantages, and objects will appear from the following Detailed Description when considered in connection with the accompanying drawings in which similar reference characters denote similar elements throughout the several views and wherein.

DETAILED DESCRIPTION

Figure 1:
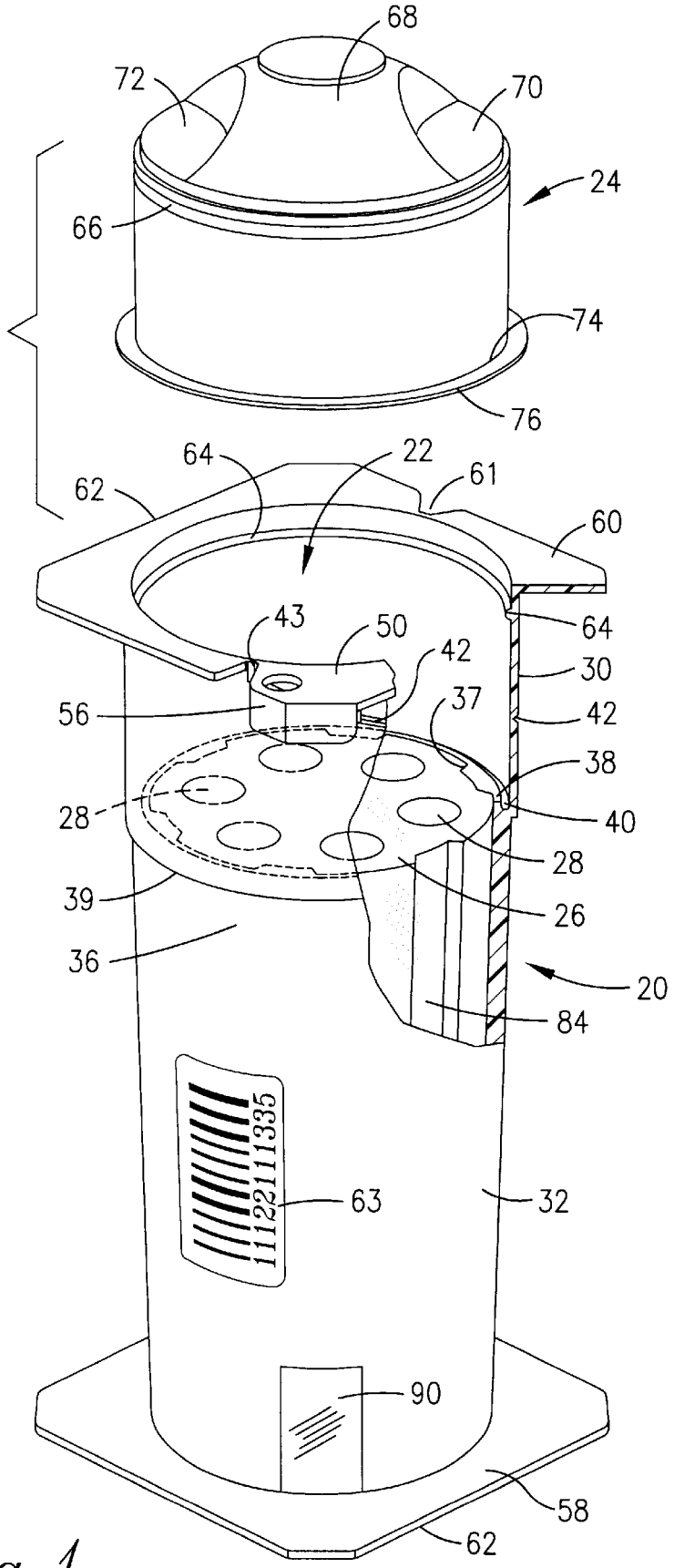
FIG. 1 is a partially exploded perspective view of a shipping device according to the present invention.

FIG. 1 shows a shipping device for packaging and transporting hazardous materials with reduced risk of breakage, leakage, infection, and injury. The shipping device comprises a main body 20 having a top opening 22 for receiving a closure lid 24. The main body houses a cushioning member 26 comprised of a resilient material such as foam with a plurality of open topped channels 28 sized to snugly receive primary specimen containers such as vials or test tubes. After specimen containers are placed inside the body within channels 28, lid 24 is inserted into opening 22 to close the body thereby sealing the specimen containers therein for shipment. Once the shipping device is closed, it can only be opened by tearing the main body open as hereafter described.

Figure 2:
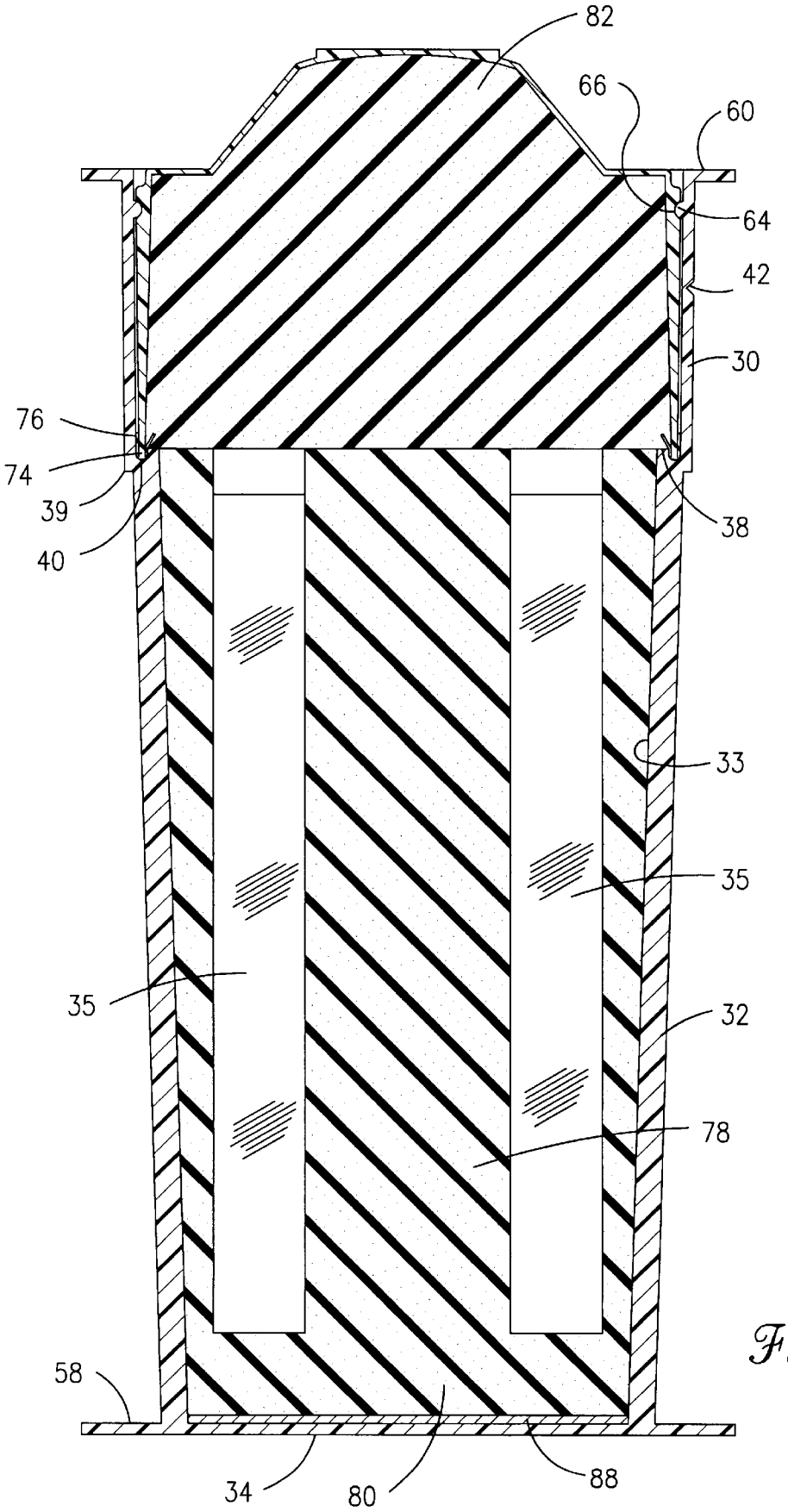
FIG. 2 is a cross-sectional view of the shipping device of FIG. 1 fully assembled.

Main body 20 is generally cylindrical with an upper lid receiving section 30 and a lower storage section 32. Referring additionally to FIG. 2, storage section 32 is generally cylindrical and defines an internal cavity 33 to receive cushioning member 26 and specimen containers 35. The diameter of internal cavity 33 gradually decreases toward the closed bottom 34 of the main body. The interior wall of storage section 32 preferably has six (6) inwardly extending reinforcing ribs 36 protruding inwardly into internal cavity 33. These ribs provide strength and stability to the storage device and also serve to prevent rotation of cushioning member 26. Reinforcing ribs 36 extend vertically and substantially parallel the central axis 41 (see FIG. 3) of the device and have beveled sides 37.

Lid receiving section 30 is immediately above storage section 32 and is connected thereto at an external step 39 defined by a change in diameter between the upper and lower sections 30 and 32 respectively. Lid receiving section 30 is cylindrical and has a substantially constant diameter along its length which is larger than the largest diameter of storage section 32. The change in diameter creates an internal annular shoulder 38 facing upwardly toward lid receiving section 30. A continuous circumferential sealing groove 40 is formed in shoulder 38 adjacent the interior wall of the container body. The internal sealing groove 40 is generally U-shaped and opens upwardly toward the top opening 22.

Figure 3:
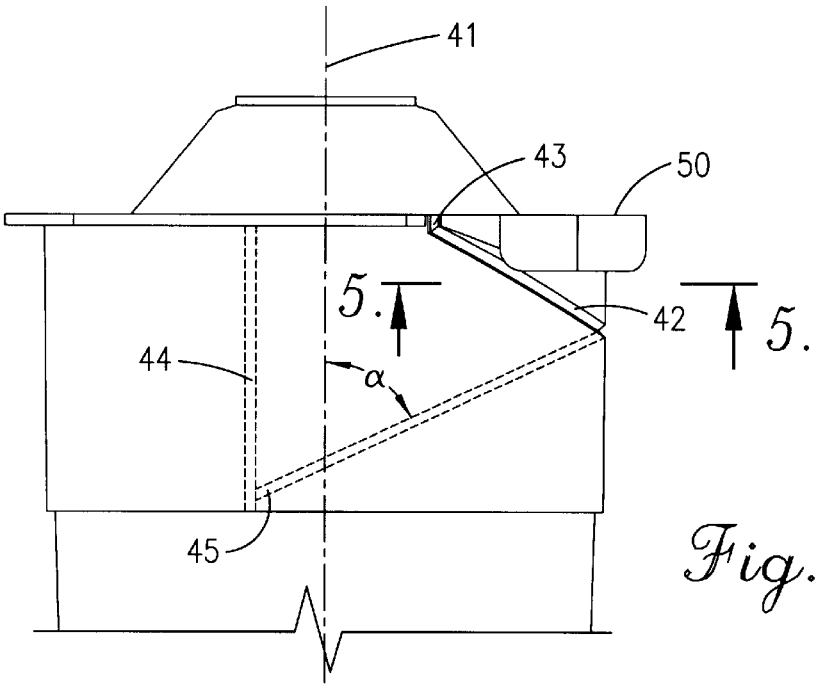
FIG. 3 is a fragmentary elevational view of the top of the device of FIG. 1.

Referring additionally to FIG. 3, lid receiving section 30 is provided with a line of weakness 42 extending from the upper edge of main body 20 along a short starting line 43 parallel the central axis of the device. The line of weakness then spirals downward across section 30 at an angle a from the central axis 41 of the device and terminating near internal shoulder 38. Angle $\alpha$ preferably ranges from approximately 50° to approximately 65°. The terminal end 45 of the spiralling line of weakness is located at the shoulder and thus does not extend into internal sealing groove 40.

Line of weakness 42 comprises a generally V-shaped groove formed within the exterior surface of lid receiving section 30 to create a narrow thin walled portion. The thin walled line is more easily torn than the remainder of the body, so that the shipping container can be torn without excessive force; and the tear is directed along and restricted to the line of weakness. A bend line 44 extends substantially parallel to the axis 41 of the device and preferably intersects the lower terminal end 45 of line of weakness 42. Bend line 44 is comprised of a rectangular groove formed within the exterior surface of the lid receiving section.

Figure 4:
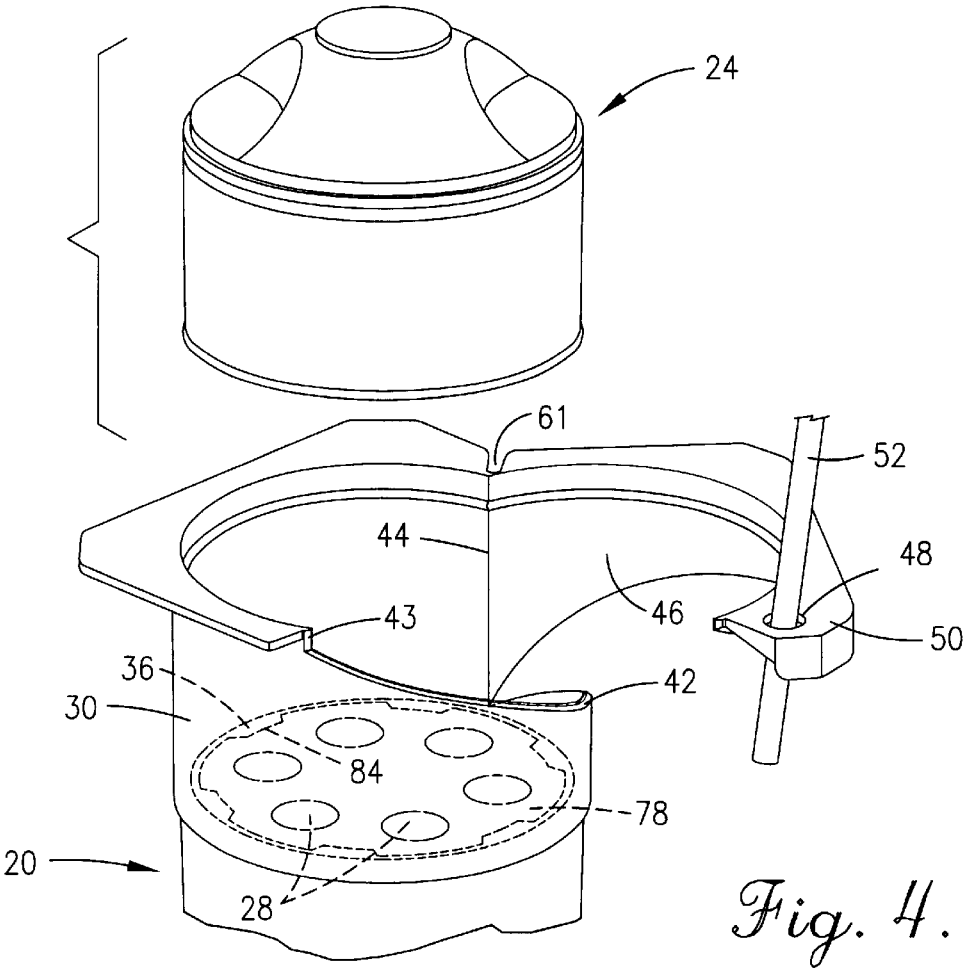
FIG. 4 is a fragmentary, partially exploded perspective view of the container of FIG. 1 illustrating the opening mechanism.

Referring to FIG. 4, line of weakness 42 and bend line 44 define a tear away opening section or flap 46 which is generally triangular and arcuate in shape. Bend line 44 allows opening flap 46 to be pulled away from the remainder of the body similar to the operation of a door with the bend line acting as a hinge. Because the bend line 44 is intended to bend and not tear, it is not formed as thin as line of weakness 42.

The opening flap 46 provides a large area of access to the lid, so that the lid can be easily grasped and removed. The top leg 96 of the flap, which corresponds to the top of the lid receiving section of the body, is approximately 45% of the entire circumference of the lid receiving section. For example, a three (3) inch diameter lid receiving section would have a top leg of approximately 4.3 inches. Further, the surface area of the flap is approximately 35% of the entire surface area of the lid receiving section. For example, a lid receiving section being three (3) inches in diameter and 1.6 inches in length would have a flap surface area of approximately 5.3 $in^2$. These ratios of lengths and surface area provide for easy low force removal of the lid which in turn reduces the risk of breaking a specimen container while opening the shipping container.

Figure 5:
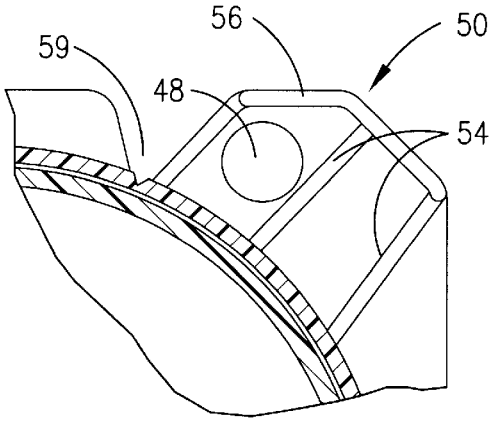
FIG. 5 is a fragmentary cross-sectional view taken along line 5—5 of FIG. 3.

Referring to FIGS. 1 and 5, a grasping flange 50 extends outwardly from the upper edge of main body 20 adjacent the beginning of line of weakness 42 for grasping and pulling thereon to tear body 20 along the line of weakness. Grasping flange 50 has an aperture 48 to receive a cylindrical object 52 for prying open flap 46 by tearing along line of weakness 42. Any item such as a dowel or ballpoint pen sized to fit into the aperture and strong enough to be used to tear the device along the line of weakness is considered satisfactory for this purpose. Reinforcing ribs 54 (FIG. 5) extending downwardly underneath and along the outer perimeter of grasping flange 50 prevent the flange from bending. Thus, the force exerted to open the device is transmitted to line of weakness 42 making it easier to tear the device.

Looking to FIG. 1, to reduce the amount of shifting or rolling experienced by the device during shipment, peripheral stabilization flanges 58 and 60 having beveled corners extend outwardly along the bottom and top edges of main body 20. The top stabilization flange 60 includes grasping flange 50 and has a first cut out 59 (FIG. 5) corresponding to the beginning of the line of weakness 42 and a second cut out 61 (FIG. 4) corresponding to the bend line 44. Stabilization flanges 58 and 60 preferably have squared long edges 62 to hold the device in a fixed position and keep it from rolling. The stabilization flanges facilitate handling and reading, for example, of a bar code label 63 affixed to the shipping device.

Looking to FIG. 1, lid receiving section 30 is further provided with a continuous circumferential closure ridge 64 projecting inwardly from the upper internal surface of main body 20. Lid 24 has a rounded closed top 65 and a continuous downwardly extending peripheral sidewall 67. Sidewall 67 is generally cylindrical in shape having an outer diameter slightly smaller than the inner diameter of lid receiving section 30, so that it may be inserted therein. A circumferential closure groove 66 forms an interference lock with closure ridge 64 to secure the lid inside lid receiving section when the lid is pushed fully therein. The top 65 of the lid is generally comprised of a dome 68 with two cutouts 70 and 72 which facilitate closure of the lid on the body. Lower edge 74 of sidewall 67 is formed with an outwardly extending peripheral flange 76 made of a thin flexible and resilient material such as plastic or rubber.

When lid 24 fitted into lid receiving section 30, flange 76 is pushed into groove 40 and is then bent upwardly to create a seal between the lid and the body as shown in FIG. 2. Flange 76 is preferably made of a very thin resilient material and is most preferably formed of the excess material known as flashing extending from the bottom edge of the lid as a result of the molding process. The plastic flashing 76 helps create a seal between the lid and the body. The flashing 76 resists deflection to enhance the seal by pressing against the walls of the U-shaped groove 40. Leaving the flashing on the lid also reduces production cost by eliminating a manufacturing step.

Cushioning member 26 made of a resilient material such as foam is inserted inside the shipping container, and in the embodiment shown comprises two sections. The top member 82 is fitted within lid receiving section 30, and the lower member 78 is fitted within storage section 32. Lower member 78 includes vertically extending channels 28 for receiving specimen containers 35 that do not extend to the bottom 80 of lower member 78. Specimen containers 35 fit snugly into channels 28 and are further held in the channels by solid top cushioning member 82. Lower cushioning member 78 comprises six (6) external slots 84 (FIG. 1) to mate with the six reinforcing ribs 36 extending inwardly from the internal surface of storage section 32. Alternatively, a flat sheet of foam may be rolled around the specimen containers so that at least one layer of foam separates each specimen container from the others.

It is preferable to incorporate a direct indicator into the cushioning material to detect a leak of any specimen within the device. The indicator may comprise pH paper 88 (FIG. 2) laminated to all or only one surface of the cushioning material. Alternatively, a fluorescent indicator can be incorporated into the foam which will luminesce upon contact with any acidic fluids. Acceptable pH papers are cresol red, methyl violet, curcumin yellow or brown, and an acceptable fluorescent indicator is fluorescent yellow 3G.

These visual indicators may be used in conjunction with a shipping device having at least one transparent portion 90 to allow even the casual observer to notice that a leak has occurred. Further, the cushioning material may also be impregnated with a germicidal or pesticidal substance to render inert any potential infectious materials which escape from the specimen containers.

Figure 6:
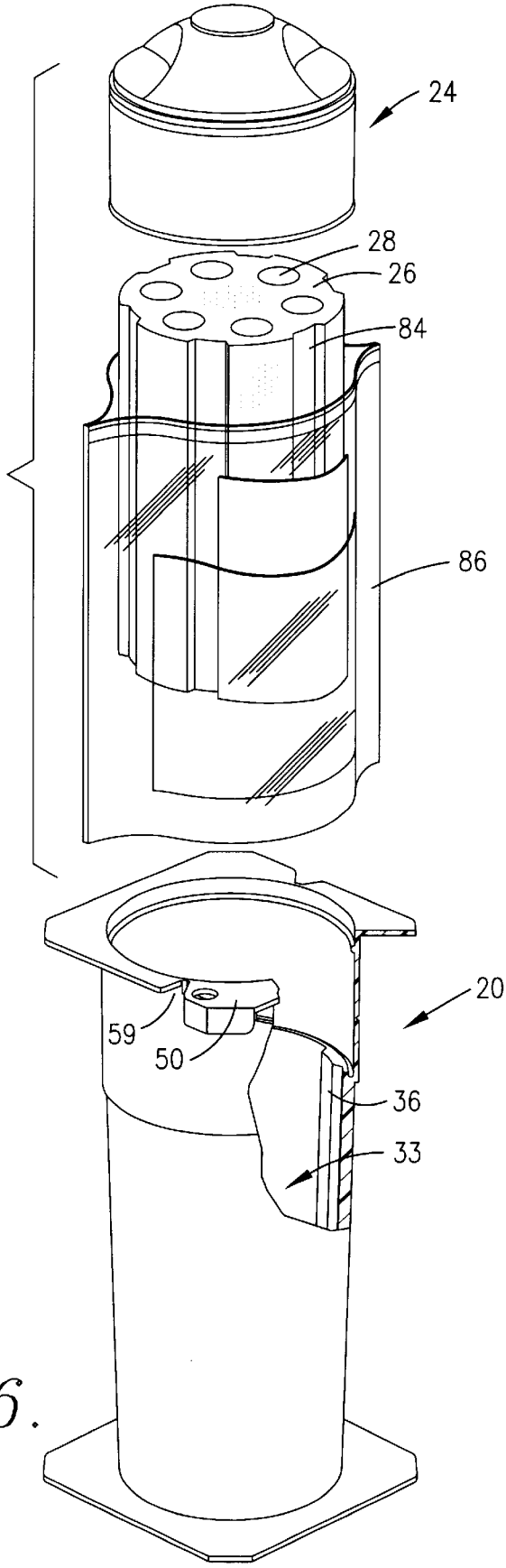
FIG. 6 is an exploded perspective view illustrating a containment system used in conjunction with the device of FIG. 1.

With reference to FIGS. 2 and 6, in use the specimens are collected and placed into specimen containers such as vials 35. The specimen containers are inserted into channels 28 of lower cushioning member 78. As a further precaution, the cushioning members with the specimen containers therein may be inserted and sealed inside of a sealable plastic bag 86 as illustrated in FIG. 6. Bag 86 may optionally include an exterior pocket 92 for holding written documentation 94 regarding the contents of the device.

After the cushioning member 78 and specimen containers 35 are placed inside of main body 20 with reinforcing ribs 36 received within slots 84, the top cushioning member 82 is positioned over the lower storage section and lid 24 is then inserted into lid receiving section 30 until ridge 64 snaps into groove 66. As ridge 64 is snapped into groove 66, flange 76 is inserted into U-shaped groove 40 thereby sealing the connection between the lid and the body. With lid 24 inserted into body 20, so that closure ridge 64 is snapped into groove 66, the lid cannot be removed from the body without destroying the container, normally by tearing the lid receiving section along external line of weakness 42.

To open the shipping device, an individual applies a force to grasping flange 50 that is directed generally downward and away from the device to tear the body along line of weakness 42 thereby preventing reuse of the container. The path of the force follows the direction of the line of weakness, so that the force path also spirals downwardly around the shipping device. The force can be applied in various ways including grasping the grasping flange between the thumb and index finger and pulling, pushing on the grasping flange with the heel of the hand, or inserting a cylindrical object 52 (FIG. 4) through aperture 48 in the grasping flange to gain leverage. With the object inserted through aperture 48, the person opens the shipping container by simply pulling on an end of the object. For further advantage, the opposite end of the object can be braced against body 20 of the shipping container.

If the visual indicator reveals a leak, the individual can take additional precautions while opening the shipping device or discard the device without opening it as may be appropriate. Opening flap 46 provides a large area of access to lid 24 so that it can be easily grasped and removed. The specimen containers 35 are provided below lid receiving section 30 in storage section 32, such that even when the device is opened and lid 24 removed, the user is protected from direct contact with any potentially spilled specimen.

While preferred embodiments and particular applications of this invention have been shown and described, it is apparent to those skilled in the art that many other modifications and applications of this invention are possible without departing from the inventive concepts herein. For example, the mating arrangement between the body and the lid could be reversed without sacrificing the ability of the shipping device to seal. It is, therefore, to be understood that this invention may be practiced otherwise than as specifically described. Though some of the features of the invention may be claimed in dependency, each feature has merit if used independently.

What is claimed is:

1. A shipping device for transporting and storing hazardous material containers, the shipping device comprising:

a closure lid having a closed top and a continuous peripheral sidewall extending downwardly from the top to a bottom edge;

a generally cylindrical main body defining a central cavity for holding hazardous material containers, said body having a closed bottom, an open top, a lid receiving section adjacent the open top, and an upwardly facing annular shoulder within said body adjacent a lower end of said lid receiving section;

an upwardly opening internal sealing groove in said shoulder for receiving said bottom edge of the lid when the lid is applied to said body to close said open top, said groove having a groove wall; and a flexible circumferential flange extending outwardly from said bottom edge of the lid, said flange bending upwardly when said bottom edge is applied to said groove and said flange resisting deflection to press against said groove wall for sealing the lid to the body.

2. The shipping device according to claim 1, further comprising an external line of weakness extending through the lid receiving section.

3. The shipping device according to claim 2, wherein the internal sealing groove is continuous.

4. The shipping device according to claim 2, wherein the lid comprises a circumferential closure groove, the body comprises an internal circumferential closure ridge snapable into the closure groove, and the closure ridge is continuous.

5. The shipping device according to claim 1, further comprising a direct indicator for detecting a specimen leak.

6. The shipping device according to claim 5, wherein the direct indicator comprises an indicator inside one of either the body and the lid.

7. The shipping device according to claim 6, further comprising a cushioning member for holding hazardous material containers inside the body.

8. The shipping device according to claim 6, further comprising a cushioning member for holding the hazardous materials inside the body, and wherein the indicator is selected from the group consisting of a pH indicator and a fluorescent indicator.

9. A shipping device for transporting and storing hazardous materials in primary containers, the shipping device comprising:

a generally cylindrical body for holding the specimen containers, said body having a central axis, and an upper lid receiving section;

a lid for engagement in the lid receiving section; and a spiralling line of weakness extending on the lid receiving section to provide a line along which the lid receiving section can be torn for access to the lid for removal thereof.

10. The shipping device according to claim 9, wherein the spiralling line of weakness extends at an angle between approximately 50® and approximately 65° from the central axis.

11. The shipping device according to claim 9, wherein the spiralling line of weakness comprises an external groove.

12. The shipping device according to claim 9, further comprising a lower storage section located below the upper lid receiving section and holding the specimen containers, and wherein the spiralling line of weakness does not enter the lower storage section.

13. The shipping device according to claim 9, further comprising a grasping flange adjacent an upper end of the spiralling line of weakness and the grasping flange having an aperture for receiving an opening tool.

14. The shipping device according to claim 9, further comprising a bend line on the lid receiving section substantially parallel a central axis of the device and intersecting a terminal end of the spiralling line of weakness.

15. The shipping device according to claim 14, wherein the lid receiving section includes a substantially triangular and arcuate opening flap defined by the bend line and the spiralling line of weakness.

16. The shipping device according to claim 9, wherein the lid receiving section includes a substantially triangular and arcuate opening flap separable from the lid receiving section along the line of weakness to enable the lid to be removed from the body.

17. The shipping device according to claim 9 wherein the spiralling line of weakness comprises a short starting line extending substantially parallel a central axis of the device.

18. The shipping device according to claim 9, further comprising a lower storage section below the upper lid receiving section for holding the specimen containers, and wherein the lower storage section comprises a plurality of reinforcing ribs having a length substantially parallel a central axis of the device.

19. The shipping device according to claim 18, further comprising a cushioning material fitted inside the body and having channels to receive specimen containers and having external slots to mate with the reinforcing ribs.

20. The shipping device according to claim 9, further comprising a plurality of stabilizing flanges defined in planes substantially perpendicular the central axis of the device to enable the device to be maintained in a fixed position.

* * * * *